United States Patent [19]

Berlec et al.

[11] 4,296,352

[45] Oct. 20, 1981

[54] INCANDESCENT LAMP

[75] Inventors: Ivan Berlec, South Euclid; Lewis V. McCarty, Cleveland Heights, both of Ohio

[73] Assignee: General Electric Company, Schenectady, N.Y.

[21] Appl. No.: 105,329

[22] Filed: Dec. 19, 1979

[51] Int. Cl.[3] ..... H01K 1/42; H01K 7/08

[52] U.S. Cl. ..... 313/315; 313/341; 313/345; 427/111

[58] Field of Search ..... 313/341, 344, 345, 315; 427/111

[56] References Cited

U.S. PATENT DOCUMENTS

| | | | |
|---|---|---|---|
| 1,123,625 | 1/1915 | Thowless | 427/111 |
| 1,149,701 | 4/1916 | Thowless | 427/111 |
| 1,410,499 | 3/1922 | Pacz | 117/217 |
| 2,225,239 | 12/1940 | Spaeth | 313/345 X |
| 3,075,120 | 1/1963 | Schnitzel | 313/341 X |
| 3,798,490 | 3/1974 | Ackerman et al. | 313/344 |
| 3,811,936 | 5/1974 | Archer et al. | 117/217 |

FOREIGN PATENT DOCUMENTS

| | | | |
|---|---|---|---|
| 1452190 | 10/1976 | United Kingdom | 313/341 |

*Primary Examiner*—Saxfield Chatmon, Jr.
*Attorney, Agent, or Firm*—John F. McDevitt; Lawrence R. Kempton; Philip L. Schlamp

[57] ABSTRACT

An improved incandescent lamp filament is described having an inner core of doped tungsten crystals with a surface layer of chemically vapor deposited undoped tungsten crystals. The inner core material exhibits the sag-resistant grain structure obtained with dispersion alloy products of tungsten whereas the unalloyed tungsten crystals in the surface layer are of a finer size and can further exhibit a preferred crystallographic orientation. Incandescent lamps utilizing said improved tungsten filaments exhibit increased vibration resistance and greater notch resistance when operated on direct current.

16 Claims, 1 Drawing Figure

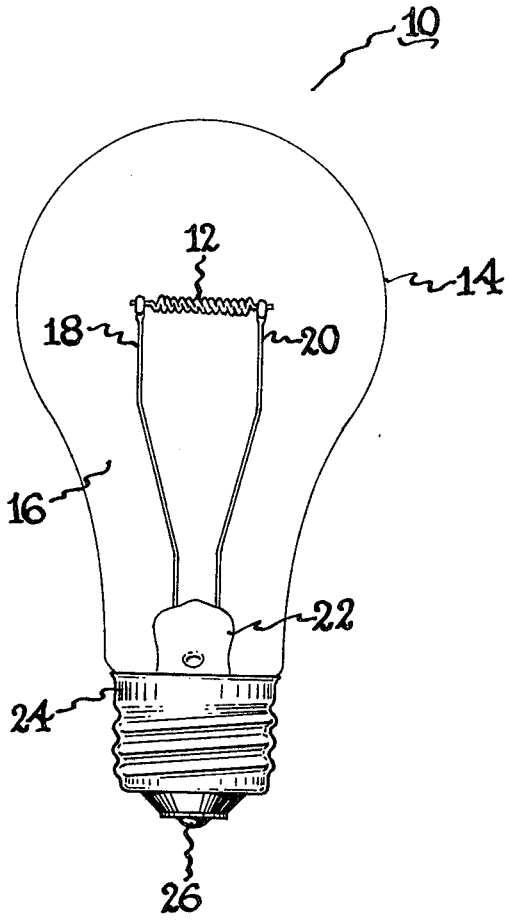
10
12
14
18
20
16
22
24
26

INCANDESCENT LAMP

BACKGROUND OF THE INVENTION

Dispersion alloy products of tungsten are well known wherein a tungsten grain structure in the final product such as a wire, a coil, or other type incandescent lamp filament is obtained having a non-sag grain structure attributable to incorporation of various additives. For example, U.S. Pat. No. 1,410,499 discloses various graingrowth promoting additives such as aluminum, silicon, and potassium compounds which can be uniformly distributed in the initial tungsten powder to achieve the desired objective. It is also known to vapor deposit a volatile tungsten compound together with the dopant materials on a suitable tungsten substrate as well as to vapor deposit the volatile tungsten compound by itself. An early recognition of the type tungsten crystal structure obtained by such vapor deposition appears in U.S. Pat. No. 1,149,701 which describes such tungsten deposit obtained by vacuum flash technique as long crystals lying radially with respect to the longitudinal axis of a tungsten incandescent lamp filament. Subsequent drawing of said composite wire product in the conventional manner to effect size reduction is said to produce a final lamp filament exhibiting improved ductility attributed to the fibrous nature and purity of the tungsten deposit.

Despite prior art recognition for some time that vapor deposited tungsten coatings can be used to improve incandescent lamp filaments, however, there has not been any major use made of such technology as a practical matter. The benefits obtained with the prior art coatings thereby apparently have not yet justified any additional effort to modify conventional incandescent lamp filaments in this manner. Consequently, it would increase the general utilization of vapor deposited tungsten coatings if additional significant performance benefits could be imparted thereby to incandescent lamp filaments, especially tungsten filaments.

SUMMARY OF THE INVENTION

It has now been discovered, surprisingly, that a conventional tungsten incandescent lamp filament comprising doped tungsten crystals exhibiting the sag-resistant grain structure can be improved by a surface deposit of undoped chemically vapor deposited tungsten crystals to impart improved vibration resistance which is retained at the elevated operating temperatures experienced in incandescent lamps. Specifically, it has been found that incandescent lamps utilizing the improved filaments demonstrate improved vibration resistance at lamp operating temperatures up to at least 2700° C. and greater. The particular tungsten crystalline structure of the improved incandescent lamp filament comprises an inner core of doped tungsten crystals exhibiting the sag-resistant grain structure and a surface layer of chemically vapor deposited undoped tungsten crystals which impart increased vibration damping and lower shear modulus values at elevated temperatures to the composite lamp filament. Initially deposited undoped tungsten coatings produce a brittle condition, however, requiring further proper treatment in order to achieve these benefits.

In one preferred embodiment, the crystallographic orientation in the chemically vapor deposited tungsten coating is retained in the final composite lamp filament so that a surface columnar grain structure of the undoped tungsten crystals is observed which are aligned transverse to the filament longitudinal axis. Heating of the composite lamp filament at temperatures as low as 200° C. permits coiling said filament in the otherwise conventional manner to produce a final tungsten filament having a coil configuration. Such heat treatment of the undoped tungsten crystals at a thickness of at least about 0.0002 inch effectively provides the improved vibration resistance when utilized in otherwise conventional incandescent lamps. Additionally, said lamps further exhibit significantly greater resistance to filament "notching" when operated on direct current which is attributable to preserving the relatively smaller size of the undoped tungsten crystals as compared with the underlying doped tungsten crystals.

In a different preferred embodiment, the initial undoped tungsten deposit undergoes modification of the grain structure when the diameter of the composite wire product is reduced through a die in the conventional manner. Such mechanical and thermal processing eliminates the columnar grain structure of the undoped tungsten deposit to provide equiaxed crystals again having a smaller size than the doped tungsten crystals comprising the inner core of said duplex grain structure. Understandably, such removal of the surface columnar grain structure in this manner avoids need for heat treatment during coiling or further processing of the drawn wire product. Recrystallization of the duplex grain structure by slow heating up to approximately 2527° C. produces the conventional large elongated grain structure in the inner core while still preserving a relatively fine grain equiaxed structure in the undoped surface tungsten deposit.

DESCRIPTION OF THE DRAWING

The accompanying FIGURE is an elevation view in cross section illustrating a conventional screw type base incandescent lamp utilizing the improved incandescent filament of the present invention.

DESCRIPTION OF THE PREFERRED EMBODIMENTS

Referring now to the accompanying drawing, an illustrative incandescent lamp 10 is shown having the novel tungsten coil 12 of the present invention disposed in a horizontal position. As therein illustrated, the lamp is of an otherwise conventional design comprising a sealed envelope 14 of light transmissive material containing the lamp filament 12 which may be in the shape of a helical coil having its ends secured to inlead support means 16 in the form of a pair of lead-in conductors 18 and 20 which have portions thereof hermetically sealed in the press or pinch portion of the lamp envelope. Accordingly, said lamp envelope may be made of glass and said lead-in conductors 18 and 20 extend to a metal shell member 24 having an eyelet 26 which forms a screw type base for said incandescent lamp. A gas filling or vacuum (not shown) is also generally included within the lamp envelope of said conventional lamp construction.

Comparison tests were conducted upon incandescent lamp filaments suitable for use in the above type lamp construction and prior to fabrication of the coil configuration used in said lamps. These tests consisted of comparing the internal friction or damping and shear modulus measurements obtained in the same manner as described in a technical article entitled "The Effects of Impurities and Heat Treatment on the Internal Friction of Tungsten at High Temperatures," Metallurgical Transactions, Volume 1, October, 1970, pages 2677–2683. Generally, said internal damping or friction measurements were performed in a vacuum of approximately $10^{-6}$ torr with 15 centimeter long samples of the incandescent lamp filaments at approximately the same wire diameter size. The wire size of the conventional doped tungsten lamp filament tested was approximately 0.007 inch diameter whereas the wire diameter size for the incandescent lamp filament for this test was approximately 0.0053 inch diameter with a 0.001 inch diameter core of the same doped tungsten crystal structure. The wire samples were mounted in the torsion pendulum apparatus for heating. The wire specimens were heated by self-resistance using a highly rectified direct current and temperature was measured on the heated wires with an optical micro-pyrometer. The internal friction values ($Q^{-1}$) measured in the foregoing manner are reported in Table 1 below along with the measurement temperature and certain shear modulus values obtained both at room temperature and the same elevated temperatures therein reported. The shear modulus values obtained in the same apparatus are reported in ratio form where $G_t$ represents the shear modulus value at the reported measurement temperature and $G_o$ represents the shear modulus value at room temperature. The shear modulus values were further obtained in accordance with the following relation:

$$G = \frac{128 \cdot \pi \cdot L \cdot I \cdot f^2}{d^4}$$

where

I is the moment of inertia of the vibrating system;
L is the length of the sample;
f is the natural frequency of vibration;
d is the diameter of the sample.

Accordingly, by measuring the frequency of free vibrations as a function of temperature, one can be using the above mathematical relationship, calculate the shear modulus of the wire samples at any desired temperature.

TABLE 1

| Filament Material | Temperature (°C.) | Shear Modulus $\left(\frac{G^t}{G_o}\right)$ | Internal Friction ($Q^{-1}$) |
|---|---|---|---|
| Doped Tungsten | 2627 | 0.55 | $6 \times 10^{-2}$ |
| Undoped Tungsten Coating | 2627 | 0.42 | $25 \times 10^{-2}$ |
| Doped Tungsten | 2427 | 0.60 | $6 \times 10^{-2}$ |
| Undoped Tungsten Coating | 2427 | 0.45 | $22 \times 10^{-2}$ |

As can be noted from the above Table 1, the much higher internal friction values ($Q^{-1}$) for the undoped tungsten coated incandescent filaments of the present invention as compared with conventional doped tungsten filaments clearly demonstrates the improvement obtained in vibration resistance at the elevated temperatures of lamp operation. Such improvement is believed attributable to retention of the relatively finer grain structure in the surface undoped tungsten layer which although experiencing some grain growth during the high temperature heating did not recrystallize into the larger elongated grain structure observed in the underlying doped tungsten core material. The accompanying lower shear modulus ratios obtained for the undoped tungsten coated incandescent filaments of the present invention as compared with said values for the conventional doped tungsten filaments does indicate some loss in shear strength at the elevated temperatures of lamp operation. As can be noted, this observed loss of approximately 25% in the shear strength which is also attributable to the relatively finer grain structure of the undoped tungsten coating surprisingly does not adversely influence the lamp vibration resistance but rather increases this desirable performance characteristic. Comparison lamp tests were conducted wherein 25 watt size model 25 T8DC incandescent lamps according to the present invention were compared for vibration resistance during operation in a vacuum cleaner with the same type lamps using incandescent lamp filaments produced from a doped tungsten material containing approximately 3% rhenium by weight. Said rhenium containing tungsten alloy was selected by reason of the known failure of conventional doped tungsten filaments for this particular vacuum cleaner product application. A test lot of eight lamps produced according to the present invention met the required operating specifications as compared with failure of two lamps in a six-lamp lot using filaments made with the rhenium containing tungsten alloy.

It can be appreciated from the foregoing description of preferred embodiments employed to form the novel incandescent lamp filaments of the present invention that various modifications can be used to provide comparable results. For example, the same or greater improvements would be contemplated by substituting the above identified rhenium doped tungsten material for conventional doped tungsten and otherwise proceeding as herein taught. It is intended to limit the present invention, therefore, only to the scope of the following claims.

What we claim as new and desire to secure by Letters Patent of the United States is:

1. An incandescent lamp filament comprising a tungsten wire having an inner core of tungsten crystals doped with grain growth promoting additives selected from aluminum, silicon and potassium compounds to exhibit sag resistance and a surface layer of chemically vapor deposited undoped tungsten crystals imparting increased vibration damping and lower shear modulus value at elevated temperatures to the lamp filament.

2. An incandescent lamp filament as in claim 1 wherein the vapor deposited undoped tungsten crystals are of smaller size than the doped tungsten crystals as well as having a preferred crystallographic orientation transverse to the filament longitudinal axis.

3. An incandescent lamp filament as in claim 1 wherein the vapor deposited undoped crystals are of smaller size than the doped tungsten crystals as well as having an equiaxed crystallographic structure.

4. An incandescent lamp filament as in claim 1 having a coil configuration.

5. An incandescent lamp filament as in claim 4 wherein said coil configuration was obtained at elevated temperature.

6. An incandescent lamp filament as in claim 5 wherein said coil configuration was obtained at elevated temperatures.

7. An incandescent lamp filament as in claim 3 which was drawn to a smaller size diameter after deposition of the undoped tungsten crystals.

8. An incandescent lamp filament as in claim 1 wherein the thickness of the deposited undoped tungsten crystals is at least about 0.0002 inch.

9. An incandescent lamp filament as in claim 2 wherein the doped tungsten crystals contain grain growth promoting additives.

10. An incandescent lamp having a transparent envelope which contains a tungsten filament comprising a tungsten wire having an inner core of tungsten crystals doped with grain growth promoting additives selected from aluminum, silicon and potassium compounds to exhibit sag resistance and a surface layer of chemically deposited undoped tungsten crystals imparting increased vibration damping and a lower shear modulus value at elevated temperatures to improve the vibration resistance.

11. An incandescent lamp as in claim 10 wherein said transparent envelope is glass.

12. An incandescent lamp as in claim 10 wherein said tungsten filament has a coil configuration.

13. An incandescent lamp as in claim 11 wherein said tungsten filament is electrically connected to inlead support means hermetically sealed to the glass envelope.

14. An incandescent lamp as in claim 10 exhibiting improved notch resistance when operated on direct current.

15. An incandescent lamp as in claim 10 wherein the vapor deposited undoped tungsten crystals are of smaller size than the doped tungsten crystals as well as having a preferred crystallographic orientation transverse to the filament longitudinal axis.

16. An incandescent lamp as in claim 10 wherein the vapor deposited undoped tungsten crystals are of smaller size than the doped tungsten crystals as well as having an equiaxed crystallographic structure.

* * * * *